US008955174B1

(12) United States Patent
Lawlor et al.

(10) Patent No.: US 8,955,174 B1
(45) Date of Patent: Feb. 17, 2015

(54) CHILD CONTAINER COVER

(71) Applicant: Foundations Worldwide, Inc., Medina, OH (US)

(72) Inventors: Joseph A. Lawlor, Medina, OH (US); David Stitchick, Norton, OH (US); Robert Kansa, Akron, OH (US); Mark A. Suvak, Salem, IN (US); Chris A. Wyman, Marengo, IN (US)

(73) Assignee: Foundations Worldwide, Inc., Medina, OH (US)

( * ) Notice: Subject to any disclaimer, the term of this patent is extended or adjusted under 35 U.S.C. 154(b) by 231 days.

(21) Appl. No.: 13/655,151

(22) Filed: Oct. 18, 2012

Related U.S. Application Data

(63) Continuation-in-part of application No. 29/408,922, filed on Dec. 19, 2011, now Pat. No. Des. 672,988, and a continuation-in-part of application No. 29/433,150, filed on Sep. 26, 2012, now Pat. No. Des. 699,063.

(60) Provisional application No. 61/548,595, filed on Oct. 18, 2011.

(51) Int. Cl.
*A47D 13/06* (2006.01)

(52) U.S. Cl.
USPC ..... 5/93.1; 5/98.1

(58) Field of Classification Search
CPC ..... A47D 13/063
USPC ..... 5/93.1, 98.1, 99.1
See application file for complete search history.

(56) References Cited

U.S. PATENT DOCUMENTS

| | | | | |
|---|---|---|---|---|
| 2,566,790 | A * | 9/1951 | Bloomfield | 5/93.1 |
| 5,163,191 | A * | 11/1992 | Chan | 5/98.1 |
| D416,719 | S | 11/1999 | Zaidman | |
| 6,119,288 | A | 9/2000 | Hendrickson | |
| 6,430,762 | B1 * | 8/2002 | Cheng | 5/93.2 |
| D464,220 | S | 10/2002 | Hartenstine et al. | |
| 6,895,611 | B2 | 5/2005 | Tharalson et al. | |
| D520,262 | S | 5/2006 | Hsu | |
| 7,055,191 | B1 | 6/2006 | Chen | |
| 7,284,289 | B1 | 10/2007 | Biagini | |
| D572,961 | S | 7/2008 | Costa | |
| 7,401,366 | B1 | 7/2008 | Costa | |
| 7,409,733 | B2 * | 8/2008 | Tharalson et al. | 5/98.1 |
| 7,430,770 | B2 | 10/2008 | Ramirez | |
| 7,543,342 | B2 | 6/2009 | Zhao et al. | |
| D607,220 | S | 1/2010 | Hardy et al. | |
| D616,665 | S | 6/2010 | Dumais | |
| D672,988 | S | 12/2012 | Suvak et al. | |
| 8,566,988 | B2 * | 10/2013 | Son et al. | 5/690 |
| 8,640,278 | B2 * | 2/2014 | You et al. | 5/11 |
| 8,656,530 | B2 * | 2/2014 | You et al. | 5/93.2 |
| 2005/0217026 | A1 | 10/2005 | Ramirez | |
| 2006/0168722 | A1 | 8/2006 | Ramirez | |

* cited by examiner

*Primary Examiner* — Michael Trettel
(74) *Attorney, Agent, or Firm* — Christopher L. Parmelee; Walker & Jocke

(57) ABSTRACT

A cover is provided that is adapted to wrap around at least a portion of a child container such as a crib or play yard. The cover includes at least one fabric sheet having a surface area sufficient to cover substantially all of a top face of a mattress in the child container. The sheet includes at least one mattress fastener such as a sleeve or band that is operative to mount the sheet to the mattress. The cover also includes at least one panel connected to the sheet which wraps inner faces of the walls of the child container, which extends over the upper edges of the walls, and which extends over adjacent portions of the outer faces of the walls. The at least one panel includes at least one fastener component that is usable to fasten the cover adjacent the outer faces is of the child container.

19 Claims, 6 Drawing Sheets

CHILD CONTAINER COVER

BACKGROUND

Cribs and play yards are devices designed to hold one or more child therein. A crib typically includes a mattress surrounded by walls that are sufficiently high to prevent a child from falling or climbing out of the crib. The walls of the crib may be comprised of vertical slats, rails, posts, boards, and any other elements operative to form a barrier that keeps a child within the interior space of the crib. A play yard is similar to a crib, but generally has walls comprised of a flexible material and a see-through netting/mesh fabric material held up via tubular supports. Play yards are typically designed to fold up into a compact and portable form. Also, some cribs may be operative to fold up into a more compact and portable form. As used herein and in the claims, cribs and play yards are collectively referred to herein as child containers. Another example of a child container includes a play pen, which like a crib and a play yard includes an interior space bounded by walls to keep a child in the play pen.

There is a need for improvement to existing child containers.

SUMMARY

The following is a brief summary of subject matter that is described in greater detail herein. This summary is not intended to be limiting as to the scope of the claims.

Described herein are various technologies relating to a cover for a child container (e.g., cribs and play yards) which makes the child container more sanitary. In an example embodiment, a child container includes an interior space bounded by a floor and at least one wall that extends around the floor. The floor is operative to support a mattress thereon. Such a mattress may correspond to crib/toddler spring mattress typically used in cribs. However, it should also be appreciated that the described mattress may correspond to a foldable mattress board typically used in a play yard. Such a mattress board may include several padded segments that are in hinged connection, so as to fold up into a more compact form.

An example cover for a child container may be adapted to wrap around at least a portion of the child container. Such a child container may include an interior space bounded by a floor and at least one wall that extends around the floor. The floor is operative to support a mattress (e.g., a crib mattress, play yard mattress board, or other pad) having a top face and a bottom face. In some embodiments (such as with cribs), the floor may correspond to a posture board and may be selectively positionable at different heights within the crib or other child container.

The at least one wall of the child container includes an upper edge, an inner face and an outer face. In an example embodiment, a child container with one wall that bounds an interior space may have a generally cylindrical shape, whereas a child container with four connected walls that bound an interior space may have walls mounted together to form a generally square or rectangular cuboid shape.

The cover may include at least one fabric sheet having a surface area sufficient to cover all or substantially all of the top face of the mattress. The cover may also include at least one mattress fastener (e.g., sleeves, pockets, bands) in operative connection with the sheet, which is operative to fasten the sheet to the mattress.

The cover may also include at least one panel connected to the at least one fabric sheet, the at least one panel may be configured to extend upwardly (from the at least one sheet) along the inner face of the at least one wall of the child container and extend over the upper edge of the at least wall to extend downwardly along at least a portion of the outer face of the at least one wall of the child container. The cover may also include at least one first fastener component in operative connection with the at least one panel, which is operative cooperatively engage with at least one second fastener component in operative connection with an outer face of the at least one wall of the child container. Examples of fastener components include at least one of a clip, a snap, a button, a button hole, an aperture, a loop, a slit, a grommet, an eyelet, a strap, a tie, a rope, a cable, a hook, a latch, and a buckle.

Thus, this described embodiment of the cover may have a shape that is operative to mount to the child container in a first configuration in which: the sheet extends over substantially all of the top face of the mattress positioned over the floor of the child container; and the at least one mattress fastener extends adjacent at least a portion of the bottom face of the mattress.

Also in the first configuration, the at least one panel extends upwardly from the sheet so as: to wrap at least portions of the inner face of the at least one wall of the child container; to wrap over at least portions of the upper edge of the at least one wall of the child container; to extend downwardly from the upper edge of the at least one wall along at least portions of the outer face of the at least one wall; and to enable the at least one first fastener component to extend to a position to cooperatively engage with the at least one second fastener component in order to enable the panel to be fastened to the outer face of the at least one wall of the child container.

Other aspects of embodiments described herein will be appreciated upon reading and understanding the attached figures and description.

Figure 1:
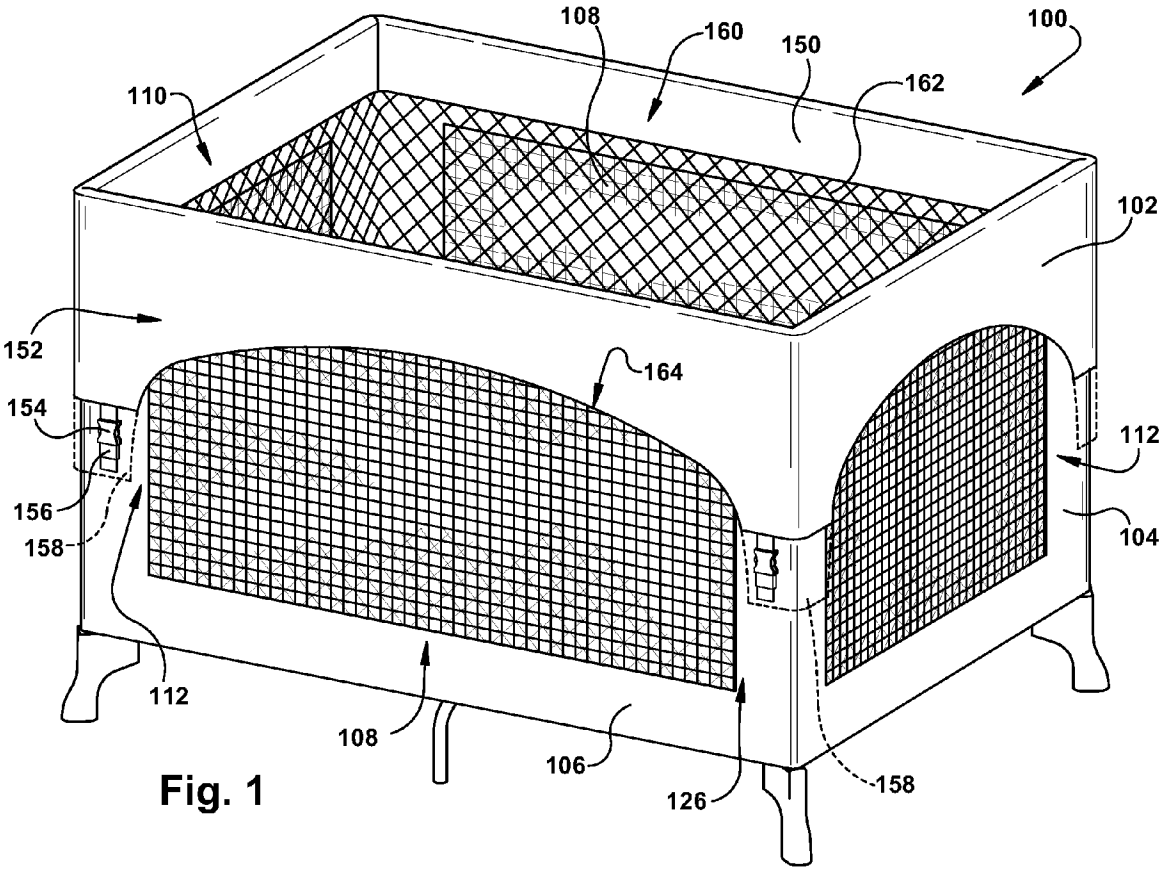
FIG. 1 illustrates an upper right side perspective view of an example embodiment of a cover mounted to a child container in the form of a play yard.

Additional drawings are also included herewith that show photographs of an example embodiment of a cover mounted to a play yard.

DETAILED DESCRIPTION

Various technologies pertaining to covers for child containers such as cribs and play yards will now be described with reference to the drawings, where like reference numerals represent like elements throughout. Also, it is to be understood that functionality that is described as being carried out by certain components, members, and devices may be performed by multiple components, members, and devices. Similarly, for instance, a component/member/device may be configured to perform functionality that is described as being carried out by multiple components/members/devices.

With reference to FIG. 1, an example embodiment 100 of a cover 102 for use with covering a child container 104 is illustrated. In this example, the child container 104 is a play yard. Such a play yard may include a metal and/or plastic frame that is operative to support side walls 106 comprising one or more flexible materials (fabrics). Such walls may also include windows 108 which allow a child to be visible through the walls 106 and which provide ventilation for the interior of the play yard. For example, such windows 108 may be formed from a see-though material such as a mesh fabric (e.g. a netting material).

Figure 2:
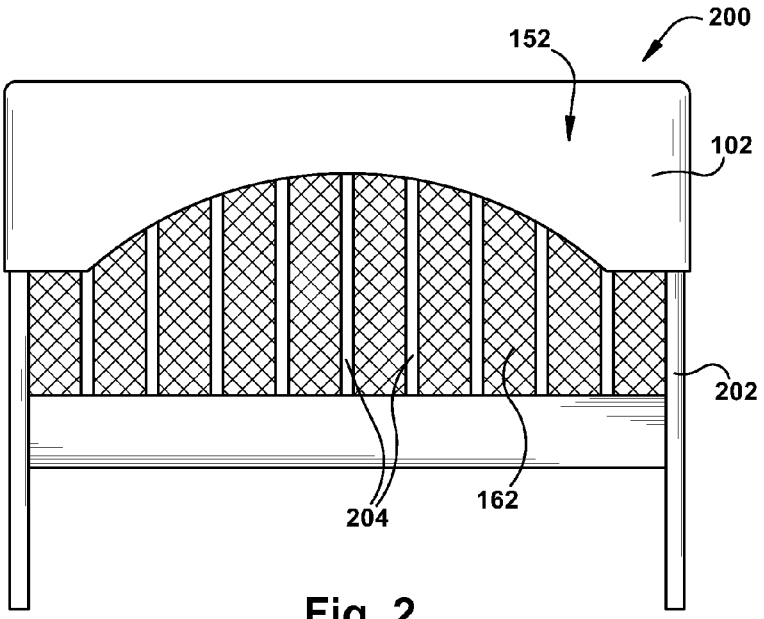
FIG. 2 illustrates a front view of an example embodiment of a cover mounted to a child container in the form of a crib.

In addition, as shown in FIG. 2, it should be appreciated that in an alternative embodiment, the cover 102 maybe adapted to mount to a crib 202 (which has walls comprised of vertical slats/bars 204) or other type of child container operative to hold children therein (e.g., a play pen).

Figure 3:
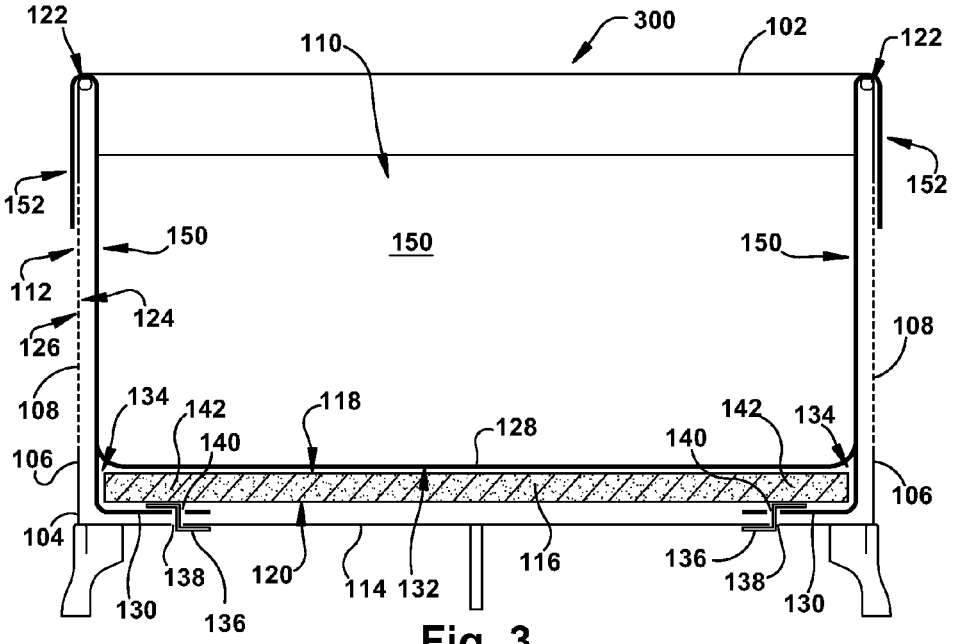
FIG. 3 illustrates a cross-sectional view of an example embodiment of the cover mounted to a child container.

Referring back to FIG. 1, the cover 102 is adapted so as to wrap an interior space 110 of the child container as well as upper portions of an exterior area 112 of the child container. To illustrate this embodiment more clearly, FIG. 3 shows a cross-sectional schematic view 300 of the cover 102 mounted to the child container 104. As shown in FIG. 3, the bottom of the interior space 110 of the child container 104 is bounded by a floor 114. The side walls 106 of the child container (which typically number in four for a rectangular play yard) extend around the floor 114 to bound the sides of the interior space.

To provide padding for a sleeping child, the floor of a child container typically supports a mattress 116 having a top face 118 and a bottom face 120. For a play yard, the mattress may include a foldable padded mattress board, whereas for a crib the mattress may correspond to a relatively thicker spring mattress. However, it should be appreciated that the mattress for a child container may correspond to any other type of removable sleeping surface with a horizontal upper surface with a surface area that is larger than the size of a typical human child under the age of two years old.

The walls 106 of the child container include an upper edge 122, an inner face 124 and an outer face 126. Also, although the walls of a play yard are typically comprised of a flexible material, it should be appreciated that the play yard typically includes a foldable metal tubular frame (not shown) that is operative to support the walls 106 in the orientation shown in the drawings.

In this described embodiment, the cover 102 includes a fabric sheet 128 (which replaces a traditional mattress sheet) having a surface area sufficient to cover all or substantially all (e.g., >75%) of the top face of the mattress. The cover also includes at least one mattress fastener 130 in operative connection with the sheet 128, which mattress fastener is operative to fasten (e.g. hold) the sheet to the mattress. In example embodiments, the mattress fastener is operative to hold the sheet to the mattress, such that a child (under that age of two years old) in the interior space 110 is unable to unfasten the sheet 128 from the mattress 116.

Figure 4:
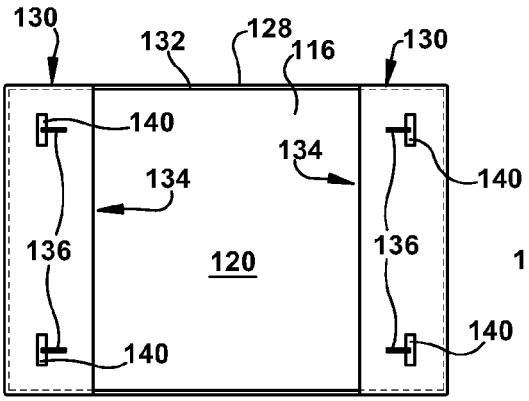
FIG. 4 illustrates a bottom view of an example embodiment of the cover fastened to a mattress.

As shown in FIG. 3, the sheet 128 includes a lower face 132. In this example, the fasteners 130 traverse (e.g., extend under) the lower face 132 of the sheet 128 to form pockets 134 with a sufficient size to receive portions (e.g., ends 142) of the mattress therein. FIG. 4 illustrates a bottom view of the sheet 128 for the previously described example of the cover which shows two fasteners 130 on opposed sides of the lower face 132 of the sheet. Each of the fasteners is connected to at least two spaced-apart portions of the sheet 128. For example, as shown in FIG. 4, each mattress fastener is connected to the opposed ends of the sheet 128 to form the pockets 134 between the mattress fasteners and the lower face 132 of the sheet.

In this described example, the mattress fasteners 130 may be comprised of the same fabric material as the sheet 128 itself. For example, the mattress fasteners may correspond to integral portions of the same fabric sheet material, which are folded, shaped and sewn to form the pockets 134. In other embodiments, the mattress fasteners may be made out of other materials that are connected to the sheet 128. Such mattress fasteners may also include elastic bands (sewn thereto) to tighten the mattress fasteners around the mattress 116.

Figure 5:
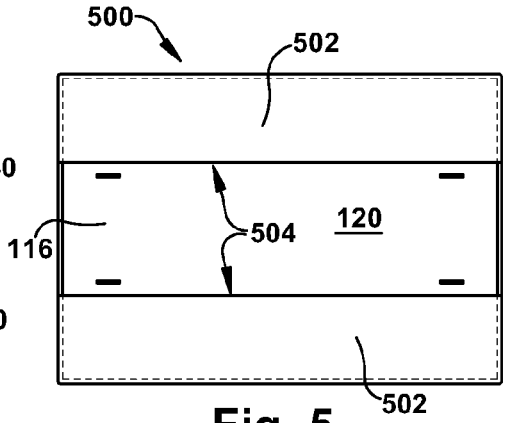
FIGS. 5-8 illustrate bottom views of alternative example embodiments of a cover fastened to a mattress.
Figure 6:
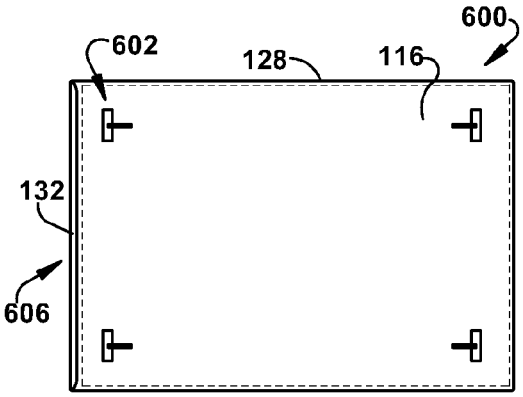

Also, it should be appreciated that alternative embodiments may have pockets with alternative shapes. For example as illustrated in FIG. 5, rather than having two pockets that receive the opposed narrower ends of the mattress, an example embodiment 500 may include mattress fasteners 502 that are positioned to form pockets 504 that receive the opposed (and relatively longer) sides of the mattress. Also, as illustrated in FIG. 6, an alternative embodiment 600 may include only a single fastener 602 that forms a single pocket 606 that receives all or substantially all (e.g. >75%) of the length of the mattress therein.

Figure 7:
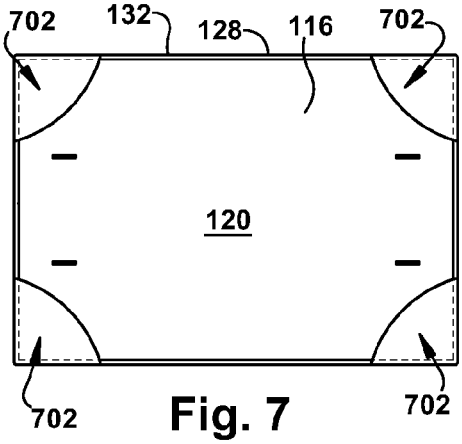
Figure 8:
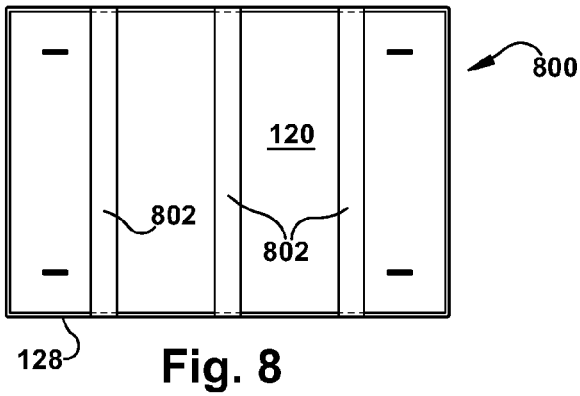

In addition, as illustrated in FIG. 7, an alternative embodiment 700 may include more than two mattress fasteners, such as four spaced apart mattress fasteners 702 positioned on the corners of the sheet 128 that form four pockets that receive the corners of the mattress 116. Further, as illustrated in FIG. 8, an alternative embodiment 800 may include mattress fasteners in the form of two or more spaced-apart bands 802 attached to opposed sides of the sheet. Such bands form loops bounded by at least portions of the sheet and a respective band, and have a sufficient size to receive at least a portion of the mattress therein.

Referring back to FIG. 3, it should be appreciated that some embodiments of the mattress used in play yards may include straps 136 that are positioned to extend downwardly from the lower face 120 of the mattress 116 and to extend through holes 138 in the floor of the play yard. The portion of the strap 136 extending through the holes 138 may mount (via hook-and-loop fasteners) to the exterior of the floor to prevent the mattress from being lifted upward by a child in the interior space 110 of the play yard. As shown in FIG. 4, to accommodate such straps 136, the mattress fasteners 130 may include apertures 140 (such as slits) that are positioned adjacent the straps on the mattress. The apertures may have sufficient size to enable the straps 136 to extend therethrough in order to mount to the exterior of the floor of the play yard as described previously.

Referring again to FIG. 3, example embodiments of the cover 102 may include panels 150 connected to the edges of the sheet 128. Such panels may be comprised of flexible materials such as fabrics. Such fabrics may include cloth material, mesh fabrics (e.g., netting), and/or other types of textiles. The fabric(s) used to form at least portions of the panels (e.g. portions that do not include mesh fabric) may be the same or different than the fabric(s) used to form the sheet and/or mattress fasteners. It should be noted that in example embodiments, different cuts of material corresponding to one or more of the sheet, mattress fastener(s), and panel(s) may be sewn or otherwise fastened together. Also in some embodiments, the cover may include at least one common/continuous piece of material that forms at least portions of the sheet mattress fastener(s) and/or panel(s).

When the cover 102 is mounted to the child container 104 in the configuration shown (with the sheet 128 fastened to the mattress and extending over substantially all of the top face 118 of the mattress when the mattress is positioned over the floor 114 of the child container), the panels 150 have a sufficient size to extend upwardly from the sheet 128 so as to span/wrap all or at least portions of the inner faces 124 of the walls 106 of the child container 104. In addition, as shown in FIG. 3, the panels 150 are operative to also wrap over at least portions of the upper edges 122 of the walls 106 of the child container, and then extend downwardly from the upper edges 122 along at least portions of the outer faces 126 of the walls 106.

As illustrated in FIG. 1, the outer portions 152 of the panels 150 that extend on the exterior of the child container 104 may include a plurality of first fastener components 154. Such first fastener components may be adapted to cooperatively engage with a plurality of second fastener components 156 mounted to the outer faces 126 of the walls 106 of the child container (e.g., to the fabric walls and/or frame of a play yard; or to the slats, rails, posts, and/or frame of a crib). The engagement of the first fastener components 154 with the second fastener components is operative to prevent the panels 150 from being pulled back into the interior space 110 of the child container 104 by a child.

In an example embodiment, such first and second fastener components 154, 156 may correspond to male/female portions of snaps, plastic buckles, and clips. Such first and second fastener components may also correspond to and/or include hook-and-loop fasteners. Such first and/or second fastener components may also include straps (e.g., which may include ropes, ties cables). Such first and/or second fastener components may also include apertures (such as slits, holes, grommets, eyelets or other reinforced openings) that are operative to receive the straps therethrough (or receive other types of fastener components such as hooks, latches, buttons, clips). It is to be understood that, the described first and second fastener components may correspond to any other type of cooperating portions of fasteners that are operative to releasable mount the outer portions 152 of the panels 150 to the walls 106 of the child container.

Figure 11:
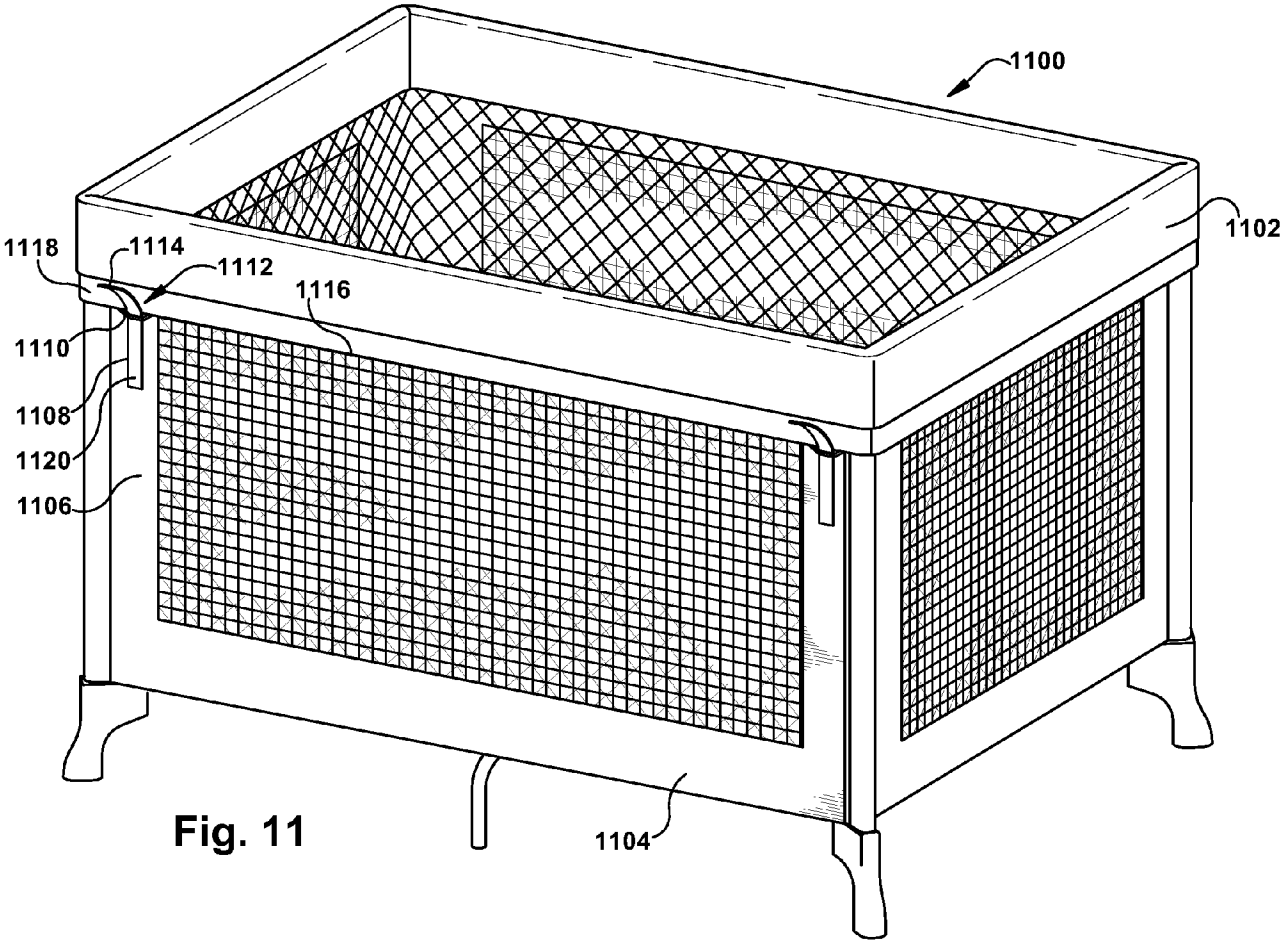
FIGS. 11 and 12 illustrate perspective views of a further alternative example embodiment of a cover mounted to a child container in the form of a play yard.

With respect to the first and second fastener components, FIG. 1 shows an example of male and female cooperative plastic buckles being used to fasten the described cover 102 to a play yard 104. In addition, FIG. 11 shows a further example embodiment 1100, with an example cover 1102 installed on a play yard 1104. In FIG. 11, the play yard includes second fastener components in the form of a plurality of straps 1108 mounted to the outer faces of at least some of the walls 1106 of the play yard 104. In this example, the cover 1102 may include first fastener components 1110 that include apertures 1112 through which upper portions 1114 of the straps 1108 may extend. As shown in FIG. 11, the first fastener components 1110 correspond to loops connected to the edge 1116 of the portions of the cover (e.g., panels) that extend adjacent the outer faces of the walls 1104 of the play yard. However, it should be noted that the first fastener components 1110 may correspond to other types of fasteners that form apertures (e.g. reinforced slits, eyelets) formed in portions 1118 of the cover adjacent the edge 1116.

Figure 12:
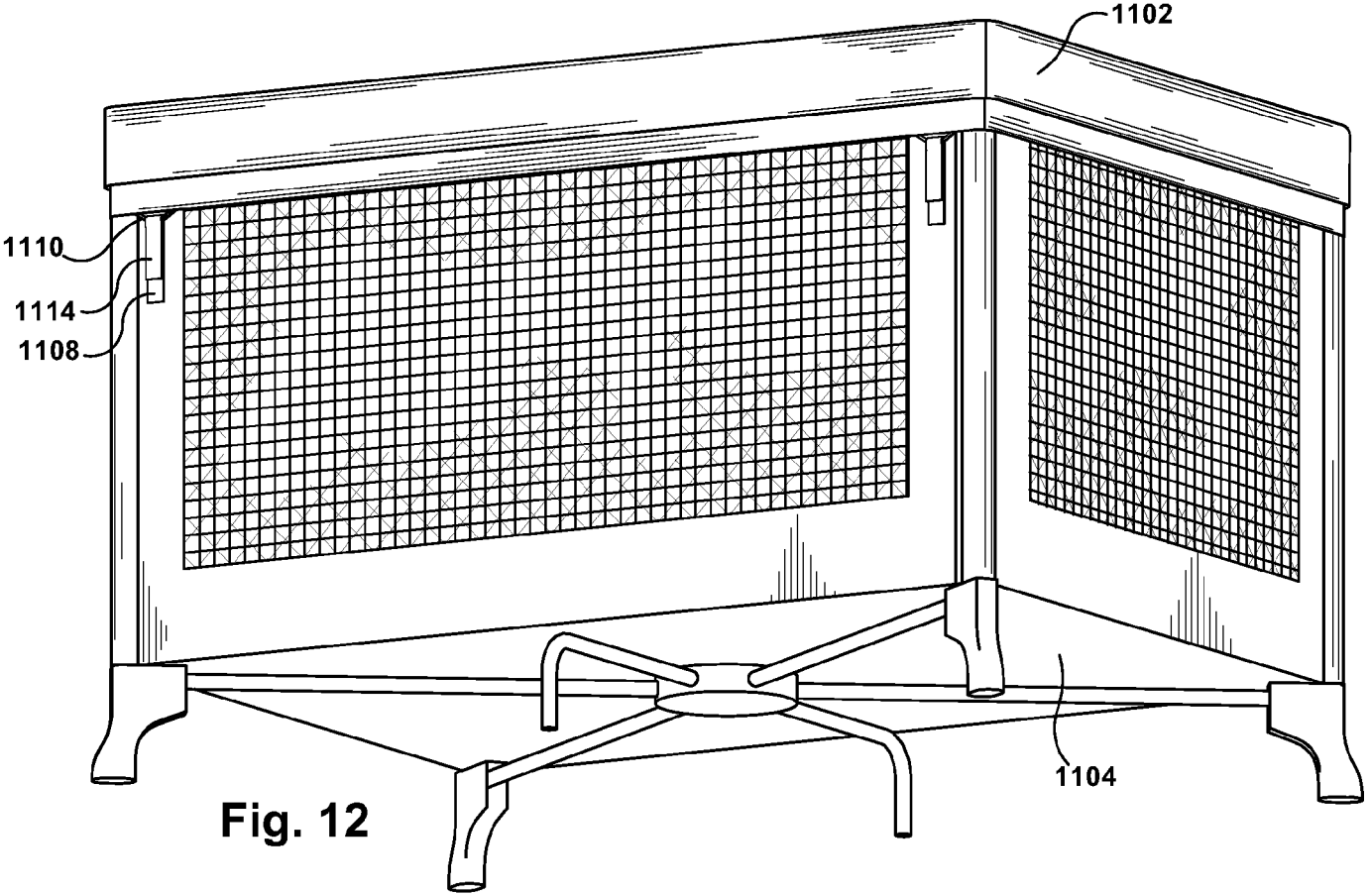

In the example shown in FIG. 11, after the upper portion 1114 of the straps 1108 have been placed through the apertures 1112 of the loops 1110, the upper portions of the straps 1114 are operative to be folded downwardly (as shown in FIG. 12) in order to fasten back to the play yard 1104. In this example, the lower portion 1120 of the straps 1108 (which are mounted to the outer faces of the walls 1106) and the upper portion 1114 of the straps 1108, may include cooperating hook-and-loop fasteners. When at least portions of the hook-and loop fasteners of the upper and lower portions 1114, 1120 of the straps are placed together, the connection therebetween may be sufficiently strong to resist being pulled apart by the tugging of the loop 1110 caused by a child pulling on the cover 1102. Also, it should be appreciated that in further embodiments the upper portion 1114 of the straps 1108 may be operative to fasten via hook-and-loop fasteners adjacent portions of the walls 1106 that do not traverse the lower portions 1120 of the straps (e.g., below the lower portions 1120).

Referring back to FIG. 1, to hide the first and second fasteners components 154, 146, in a further embodiment, the portions 152 of the outer panels 150 may include additional flaps 158 (shown in broken lines) which drape over the first and second fastener components 154, 156. Such flaps 158 may include extensions of the fabric comprising the panels 150. Also such flaps 158 may correspond to additional fabric which is sewn on the panels so as to overlie the position of the first and second fastener components 154, 156.

In these described example configurations of the cover, the sheet and panels are operative to encapsulate at least portions of the surfaces of the child container which can be contacted by a child in the interior space 110. Thus the cover 102 serves as a protective barrier which minimizes soiling of the walls and mattress of the child container from dirt, grime, feces, urine, food, blood, bacteria, viruses, hair, mucus, vomit, and/or other materials associated with the child.

In addition, it should be appreciated that the described cover may be removed from the child container and laundered so as to be mounted again to the child container in a clean and sanitary condition. Thus the described cover may be used by parents at home, at day cares, at hotels, or at any other location that uses child containers to hold one or more children. Also, it should be appreciated that the cost of the materials (fabrics, fasteners, elastic bands) needed to manufacture the cover may be substantially less than the cost to manufacture the child container. Thus after the cover becomes worn (after many cycles of use and laundering) the cover may be thrown out and replaced with a new cover without making the use of the cover uneconomical for hotels and day care centers to use on a day to day basis.

As illustrated in FIG. 1, the walls of a child container in the form of a play yard may include windows 108 in each of the four walls 106 of the play yard. As discussed previously, such windows may be comprised of a see-through material such as a mesh fabric (e.g., netting) material that includes many holes therethrough. In order to continue to permit visibility and ventilation through the walls of the play yard (or other child container), the cover 102 may include inner portions 160 of the panels 152 adjacent the inner faces of the walls 106 of the child container, which inner portions 160 are also comprised of a see-through material 162 such as a mesh fabric (e.g., netting) material. As shown in FIG. 1, the see-through material 162 of the panels 150 may traverse the windows 108 of the child container.

However, as shown in FIG. 1, the outer portions 152 of the panels 150 may not include a see-through material. Rather, the outer portions 152 of the panels 150 may include an outer edge 164 that is configured to extend around the outer faces of the walls 106 of the child container, such that at least a portion of the windows 108 of the play yard extend below at least a portion of the outer edge 164. As a result, the non-see-through material of the outer portions 152 of the panels does not completely cover the windows 108 of the child container.

As shown in FIG. 1, in some embodiments the panel edge 164 may include concave portions that traverse each of the windows 108 of the four walls of a play yard. However, in other embodiments (such as shown in FIG. 11) the panel edge 1116 may be generally straight. Also, it should be appreciated that in other embodiments, the panel edge 164 may have other shapes, such as a rectangular cut out in the areas of the windows 108. In addition, example embodiments may include elastic bands along the panel edges 164 to tighten the panels adjacent the walls 106 of the child container.

Child containers typically include various labels sewn or adhesively mounted to inner and/or outer faces of the walls/floors of the container. Such labels may include text and/or graphics operative to explain how to set up and/or use the child container. Such labels may also include text and/or graphics operative to warn users how not to use the child container. However, when the described covers are mounted to the child container, such labels may be covered as well.

Figure 9:
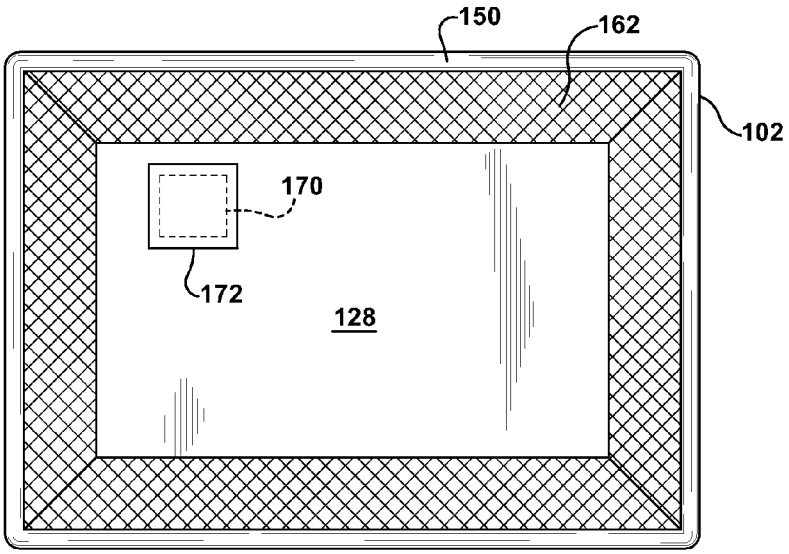
FIG. 9 illustrates a top perspective view of the cover mounted to a child container.

In order to enable the information on the labels to continue to be conveyed to a user, example embodiments may include corresponding labels as well in the same locations as the original labels being covered up by the cover. For example, FIG. 9 shows a top perspective (non-plan) view of the cover 102 mounted to a child container. Here the child container includes a label 170 (shown in broken lines) mounted on the mattress and/or floor of the child container. In this embodiment, the sheet 128 of the cover 102 includes a matching and/or similar label 172 which conveys at least some corresponding information, indicia and/or graphics as label 170. When the sheet is orientated to cover the mattress 128 (in the orientation shown in FIGS. 1 and 3), the label 172 is positioned to traverse at least portions of the label 170 of the child container. Such a label for example may correspond to a warning label, setup label, or other type of label. Also it should be appreciated that labels may also be included on the panels 150 of the cover in order to traverse matching/similar labels on the walls of the child container.

Figure 10:
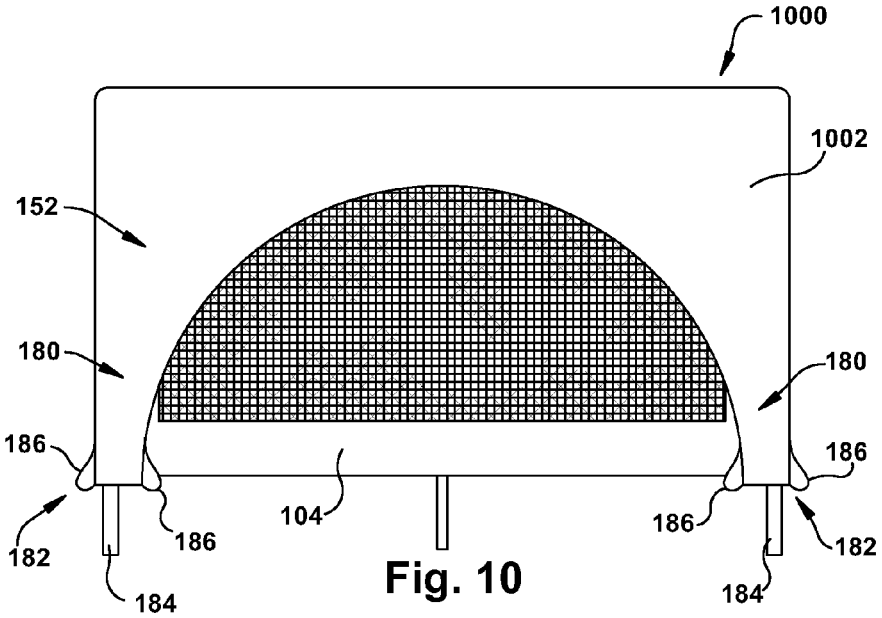
FIG. 10 illustrates a front view of an alternative example embodiment of a cover mounted to a child container in the form of a play yard.

As discussed previously with respect to FIG. 1, the cover may include first fastener components 154 adapted to engage with second fastener components 154 mounted to the walls of the child container. However, it should be appreciated that in alternative embodiments, the outer portions 152 of the panels may fasten to the child container in other ways. For example, FIG. 10 shows an alternative embodiment 1000 of a cover 1002. Here, the outer portions 150 of the panels may include sections 180 along the corners 180 of the child container 104 that extend downwardly adjacent the feet of the child container. Such sections 180 may include fasteners (e.g., snaps, straps, clips, plastic buckles, hook-and-loop fasteners) adapted to mount to or around the feet/legs 184 of the child container. For example, as shown in FIG. 10, the sections 180 may be cut to include horizontally extending flaps that include fasteners thereon adapted to engage with each other on an inner side of the feet/legs 184.

Also, it should be appreciated that the one or more of the described principles and features described herein related to a crib and play yards, may be applied to alternative embodiments and configurations of cribs and play yards. It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. An apparatus comprising:

a child container cover adapted to wrap at least a portion of a child container, which child container includes an interior space bounded by a floor and at least one wall that extends around the floor, wherein the floor is operative to support a mattress having a top face and a bottom face, wherein the at least one wall includes an upper edge, an inner face and an outer face, wherein the cover includes:

at least one sheet having a surface area sufficient to cover substantially all of the top face of the mattress;

at least one mattress fastener in operative connection with the at least one sheet, wherein the at least one mattress fastener is operative to fasten the sheet to the mattress;

at least one panel connected to the at least one sheet; and at least one first fastener component in operative connection with the at least one panel;

wherein the cover has a shape that is operative to mount to the child container in a first configuration in which:

the at least one sheet extends over substantially all of the top face of the mattress positioned over the floor of the child container;

the at least one mattress fastener traverses at least a portion of the bottom face of the mattress;

the at least one panel extends upwardly from the sheet so as:

to wrap at least portions of the inner face of the at least one wall of the child container;

to wrap over at least portions of the upper edge of the at least one wall of the child container;

to extend downwardly from the upper edge of the at least one wall along at least portions of the outer face of the at least one wall;

and to enable the at least one first fastener component to extend to a position in which the at least one first fastener component is operative to cooperatively engage with at least one second fastener component in operative connection with the child container.

2. The apparatus according to claim 1, wherein the child container includes a crib, further comprising the crib.

3. The apparatus according to claim 1, wherein the child container includes a play yard, further comprising the play yard.

4. The apparatus according to claim 1, further comprising the child container, wherein the child container includes the at least one second fastener component mounted adjacent an outer face of the at least one wall.

5. The apparatus according to claim 4, wherein the at least one first fastener component includes an aperture, wherein the at least one second fastener component includes a strap with a first end that is operative to extend through the aperture and fasten via at least one hook-and-loop fastener to the child container.

6. The apparatus according to claim 4, wherein at least one of the at least one first fastener component and the at least one second fastener component includes at least one of a clip, a snap, a button, a button hole, an aperture, a loop, a slit, a grommet, an eyelet, a strap, a tie, a rope, a cable, a hook, a latch, and a buckle.

7. The apparatus according to claim 1, wherein the at least one sheet includes a lower face, wherein the at least one mattress fastener traverses the lower face of the at least one sheet and is connected to at least two spaced-apart portions of the at least one sheet to form at least one pocket between the at least one mattress fastener and the lower face of the at least one sheet, wherein the pocket has a sufficient size to receive at least a portion of the mattress therein when the cover is mounted to the child container in the first configuration.

8. The apparatus according to claim 7, wherein the cover includes at least two mattress fasteners operative to form at least two respective pockets, wherein the pockets are spaced apart such that at least a portion of a first end of the mattress is operative to extend in a first one of the pockets, and at least a portion of the second opposed end of the mattress is operative to extend in a second one of the pockets.

9. The apparatus according to claim 7, wherein the at least one sheet is comprised of a fabric, wherein the at least one mattress fastener is comprised of the same fabric.

10. The apparatus according to claim 1, wherein the at least one sheet includes a lower face, wherein the at least one mattress fastener includes at least one band that traverses the lower face of the at least one sheet and is connected to at least two spaced-apart portions of the at least one sheet to form at least one loop bounded by at least portions of the at least one sheet and the at least one band, wherein the at least one loop has a sufficient size to receive at least a portion of the mattress therein when the cover is mounted to the child container in the first configuration.

11. The apparatus according to claim 1, wherein at least a portion of the at least one panel includes a see-through material that extends adjacent at least portions of the inner face of the at least one wall of the child container.

12. The apparatus according to claim 11, wherein portions of the at least one panel that wrap portions of the outer face of the at least one wall of the child container when mounted in the first configuration, do not include a see-through material.

13. The apparatus according to claim 11, wherein the see-through material includes a mesh fabric.

14. The apparatus according to claim 13, wherein portions of the at least one panel adjacent the outer edge of the at least one panel include at least one elastic band.

15. The apparatus according to claim 13, further comprising the child container, wherein the child container is a play yard, wherein the at least one wall of the play yard includes a window comprised of a mesh fabric, wherein when the cover is mounted in the first configuration to the child container, at least portions of the mesh fabric of the cover extend adjacent at least portions of the mesh fabric of the window of the at least one wall.

16. The apparatus according to claim 1, wherein the at least one mattress fastener includes at least one hole therein, wherein when the cover is mounted in the first configuration to the child container, at least one strap extending from the lower face of the mattress is operative to pass through the at least one hole and to fasten to portions of the child container.

17. The apparatus according to claim 1, wherein the child container includes a first warning label in a first location thereon, wherein when the cover is mounted in the first configuration to the child container, portions of the at least one panel wrap directly over the first warning label, wherein the portions of the at least one panel that wrap directly over the first warning label include a second warning label thereon that traverses at least a portion of the first location.

18. A method comprising:

a) positioning a child container cover over at least a portion of a child container, which child container includes an interior space bounded by a floor and at least one wall that extends around the floor, wherein the floor is operative to support a mattress having a top face and a bottom face, wherein the at least one wall includes an upper edge, an inner face and an outer face, wherein the cover includes:

at least one sheet having a surface area sufficient to cover substantially all of the top face of the mattress;

at least one mattress fastener in operative connection with the at least one sheet, wherein the at least one mattress fastener is operative to fasten the sheet to the mattress;

at least one panel connected to the at least one sheet; and at least one first fastener component in operative connection with the at least one panel;

wherein positioning the cover includes:

i) positioning the at least one sheet so that the at least one mattress fastener traverses at least a portion of the bottom face of the mattress and the at least one sheet extends over substantially all of the top face of the mattress when positioned over the floor of the child container;

ii) positioning the at least one panel to extends upwardly from the sheet so as:

to wrap at least portions of the inner face of the at least one wall of the child container;

to wrap over at least portions of the upper edge of the at least one wall of the child container;

to extend downwardly from the upper edge of the at least one wall along at least portions of the outer face of the at least one wall;

b) cooperatively engaging the at least one first fastener component with at least one second fastener component in operative connection with the child container.

19. The method according to claim 18, wherein the at least one first fastener component includes an aperture, wherein the at least one second fastener component includes a strap mounted adjacent an outer face of the at least one wall, wherein the strap includes a first end, wherein (b) includes placing the first end of the strap through the aperture and fastening the first end of the strap to the child container using at least one hook-and-loop fastener.

* * * * *